US005456625A

United States Patent [19]

Dumond

[11] Patent Number: 5,456,625

[45] Date of Patent: Oct. 10, 1995

[54] DOLLS FORMED IN THE LIKENESS OF THE LORD JESUS WITH A MOVABLE HEAD AND EXTREMITIES

[76] Inventor: Linda M. S. Dumond, 3093 Kahaloa Dr., Honolulu, Hi. 96822

[21] Appl. No.: 160,621

[22] Filed: Dec. 2, 1993

[51] Int. Cl.[6] ..... A63H 3/00

[52] U.S. Cl. ..... 446/268; 446/383; 446/485; 434/245; 362/121

[58] Field of Search ..... 446/268, 383, 446/485; 434/245, 246; 362/121; 428/3

[56] References Cited

U.S. PATENT DOCUMENTS

| | | | |
|---|---|---|---|
| 2,325,883 | 8/1943 | Schleif | 362/121 |
| 2,355,154 | 8/1944 | Goudreau | 428/3 |
| 2,427,655 | 9/1947 | Blankenship | 362/121 |
| 2,650,445 | 9/1953 | Randall | 428/3 |
| 3,392,821 | 7/1968 | Tracey | 428/3 |
| 3,701,215 | 10/1972 | Marason, Jr. et al. | 446/383 |
| 3,955,311 | 5/1976 | Lyons et al. | 446/383 |
| 4,136,483 | 1/1979 | Shackelford et al. | 446/383 |
| 4,571,206 | 2/1986 | Mayer et al. | 446/383 |

FOREIGN PATENT DOCUMENTS

| | | | |
|---|---|---|---|
| 531856 | 1/1929 | Germany | 446/383 |

*Primary Examiner*—Robert A. Hafer
*Assistant Examiner*—Jeffrey D. Carlson

[57] ABSTRACT

A doll formed in the likeness of the Lord Jesus with a movable head and extremities comprised of a torso section including a loin cloth molded into its lower portion and a pair of movable leg sections. The lower ends of the leg sections have a pair of feet sections secured thereto. A pair of arm sections are secured to the torso section. A pair of hand sections are secured to the lower ends of the arm sections. A head section is secured to the upper end of the torso section. The doll is provided with electrically conductive nails which when inserted through apertures in the hands of the doll, mount the doll to a provided cross and close an electrical circuit which illuminates the cross.

2 Claims, 4 Drawing Sheets

14
10
50

50
12
12
28

16
44
26
34

DOLLS FORMED IN THE LIKENESS OF THE LORD JESUS WITH A MOVABLE HEAD AND EXTREMITIES

BACKGROUND OF THE INVENTION

1. Field of the Invention

The present invention relates to dolls formed in the likeness of the Lord Jesus with a movable head and extremities and more particularly pertains to inspiring, educating and entertaining children with a doll formed in the likeness of the Lord Jesus.

2. Description of the Prior Art

The use of dolls is known in the prior art. More specifically, dolls heretofore devised and utilized for the purpose of simply entertaining children are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 3,426,476 to Ayala a doll with a free moving head.

U.S. Pat. No. 4,126,961 to Barlow discloses an articulated doll.

U.S. Pat. No. 4,268,991 to Cotey discloses a soft, flexible articulated doll.

U.S. Pat. No. 4,643,691 to Keiji discloses an articulated doll arrangement.

Lastly, U.S. Pat. No. 5,052,971 to Young discloses a soft doll with movable limbs.

In this respect, dolls formed in the likeness of the Lord Jesus with a movable head and extremities according to the present invention substantially depart from the conventional concepts and designs of the prior art, and in doing so provide an apparatus primarily developed for the purpose of inspiring, educating and entertaining children with a doll formed in the likeness of the Lord Jesus.

Therefore, it can be appreciated that there exists a continuing need for new and improved dolls formed in the likeness of the Lord Jesus with a movable head and extremities which can be used for inspiring, educating and entertaining children. In this regard, the present invention substantially fulfills this need.

SUMMARY OF THE INVENTION

In view of the foregoing disadvantages inherent in the known types of dolls now present in the prior art, the present invention provides improved dolls formed in the likeness of the Lord Jesus with a movable head and extremities. As such, the general purpose of the present invention, which will be described subsequently in greater detail, is to provide new and improved dolls formed in the likeness of the Lord Jesus with a movable head and extremities and methods which have all the advantages of the prior art and none of the disadvantages.

To attain this, the present invention essentially comprises a new and improved doll formed in the likeness of the Lord Jesus with a movable head and extremities comprising, in combination, a torso section formed of plastic in the shape of a human torso and including a loin cloth molded into its lower portion and with two laterally extending lower bulb like projections, two laterally extending upper bulb like projections and two upwardly extending bulb like projections, the projections adapted for the movable receipt of other sections. A pair of leg sections are formed of plastic in the shape of human legs, each having a bulb like recess at its upper end for receiving the lower projections of the torso to form a movable coupling therebetween, the lower ends of the leg sections having downwardly extending bulb like projections for the receipt of feet sections and with a pair of feet sections formed of plastic in the shape of human feet, each having recesses at its upper end for receiving the projections at the lower ends of the leg sections. A pair of arm sections are formed of plastic in the shape of human arms, each having a bulb like recess at its upper end and having bulb like projections extending downwardly from their lower ends and with a pair of hand sections formed of plastic in the shape of human hands, each having a bulb like recess at its upper end for receiving the projections at the lower ends of the arm sections. A head section is formed of plastic in the shape of a head with hair on the face and on the head extending downwardly beneath the lower end of the head section, the head portion having at its lower extent bulb like recesses for receiving the bulb like projections at the upper extent of the torso, the recesses of the head and arms including vertical slots to allow the pivoting therein of the head and arms. Additionally, the arms may rotate about the bulbs. Supplemental components are also provided for coupling with respect to the doll.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved dolls formed in the likeness of the Lord Jesus with a movable head and extremities which have all the advantages of the prior art dolls and none of the disadvantages.

It is another object of the present invention to provide new and improved dolls formed in the likeness of the Lord Jesus with a movable head and extremities which may be easily and efficiently manufactured and marketed.

It is a further object of the present invention to provide new and improved dolls formed in the likeness of the Lord Jesus with a movable head and extremities which are of a durable and reliable construction.

An even further object of the present invention is to provide new and improved dolls formed in the likeness of the Lord Jesus with a movable head and extremities which are susceptible of a low cost of manufacture with regard to both materials and labor, and which accordingly are then susceptible of low prices of sale to the consuming public, thereby making such dolls formed in the likeness of the Lord Jesus with a movable head and extremities economically available to the buying public.

Still yet another object of the present invention is to provide new and improved dolls formed in the likeness of the Lord Jesus with a movable head and extremities which provide in the apparatuses and methods of the prior art some of the advantages thereof, while simultaneously overcoming some of the disadvantages normally associated therewith.

Even still another object of the present invention is to inspire, educate and entertain children with a doll formed in the likeness of the Lord Jesus.

Lastly, it is an object of the present invention to provide a new and improved doll formed in the likeness of the Lord Jesus with a movable head and extremities comprising a torso section formed of plastic in the shape of a human torso and including a loin cloth molded into its lower portion and with two laterally extending lower bulb like projections, two laterally extending upper bulb like projections and two upwardly extending bulb like projections, the projections adapted for the movable receipt of other sections. A pair of leg sections are formed of plastic in the shape of human legs, each having a bulb like recess at its upper end for receiving the lower projections of the torso to form a movable coupling therebetween, the lower ends of the leg sections having downwardly extending bulb like projections for the receipt of feet sections and with a pair of feet sections formed of plastic in the shape of human feet, each having recesses at its upper end for receiving the projections at the lower ends of the leg sections. A pair of arm sections are formed of plastic in the shape of human arms, each having a bulb like recess at its upper end and having bulb like projections extending downwardly from their lower ends and with a pair of hand sections formed of plastic in the shape of human hands, each having a bulb like recess at its upper end for receiving the projections at the lower ends of the arm sections. A head section is formed of plastic in the shape of a head with hair on the face and on the head extending downwardly beneath the lower end of the head section. The head portion having at its lower extent bulb like recesses for receiving the bulb like projections at the upper extent of the torso, the recesses of the head and arms including vertical slots to allow the pivoting therein of the head and arms. Additionally, the arms may rotate about the bulbs.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figures 1, 2:
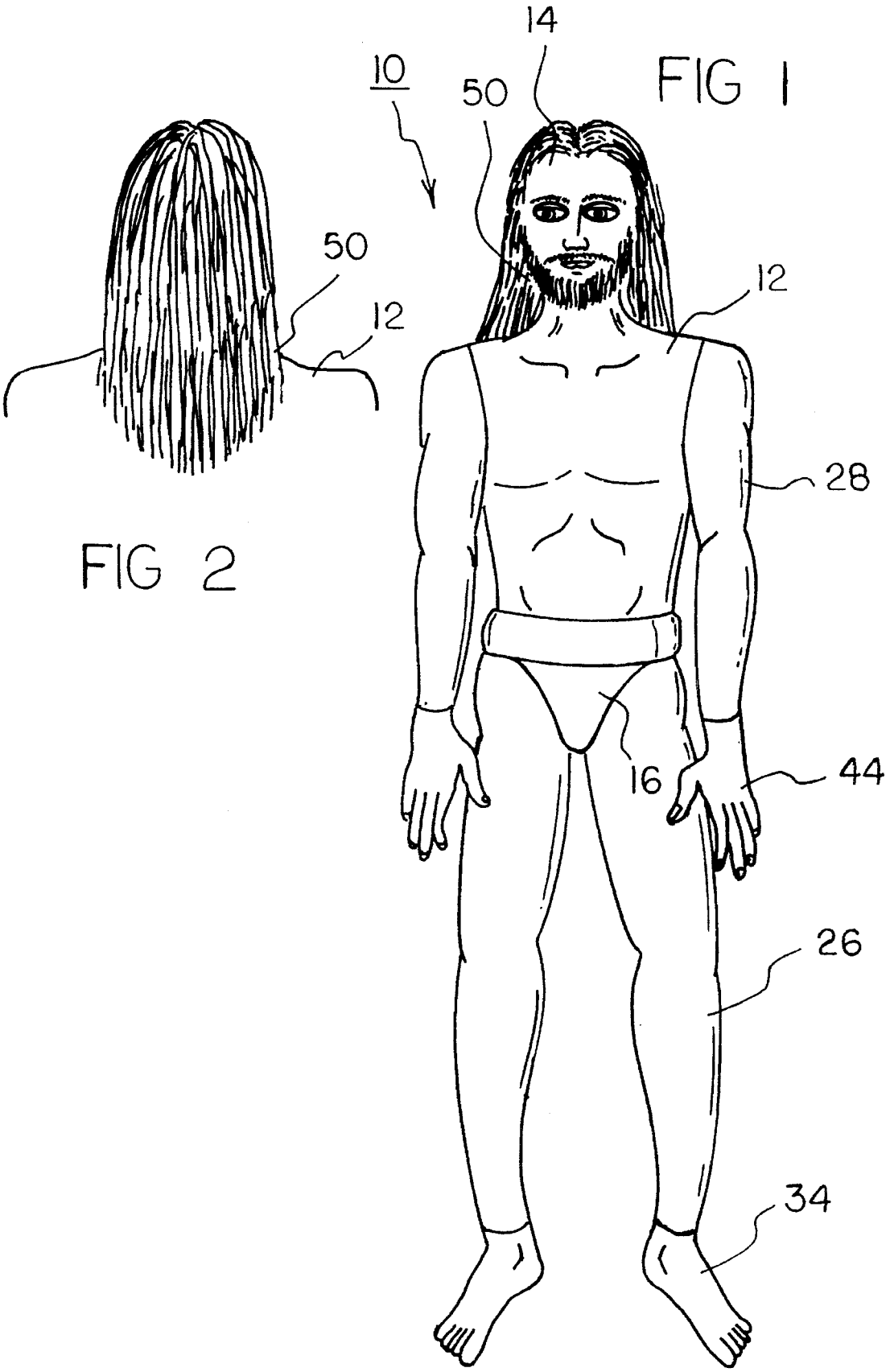
FIG. 1 is a front elevational view of the preferred embodiment of the dolls formed in the likeness of the Lord Jesus with a movable head and extremities constructed in accordance with the principles of the present invention.
FIG. 2 is a rear elevational view of the head of the doll of FIG. 1.
Figure 3:
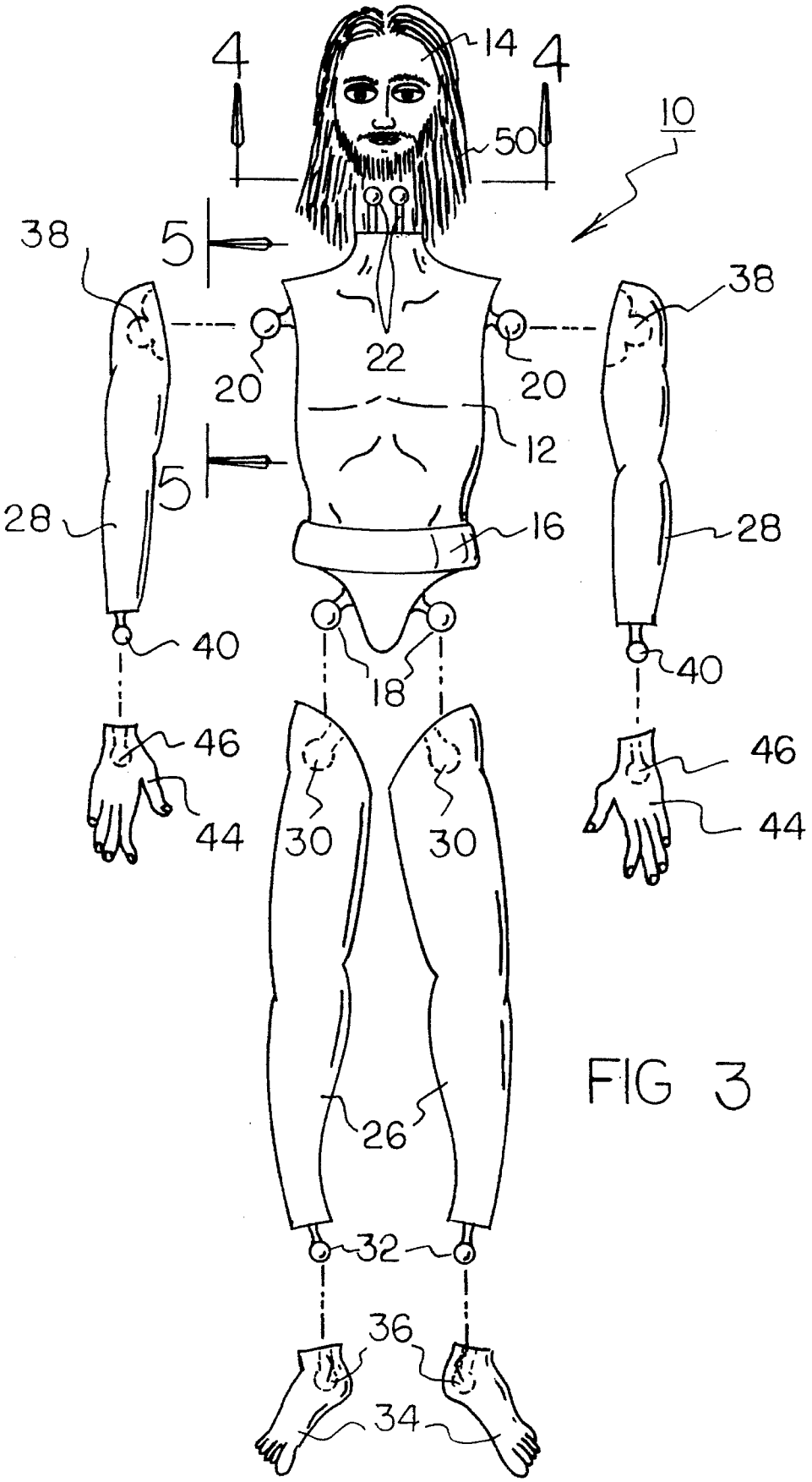
FIG. 3 is an exploded view of the doll of FIG. 1 in an exploded configuration.
Figure 4:
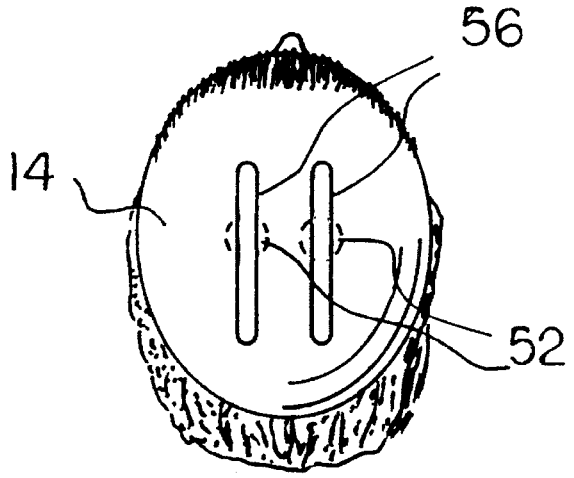
FIG. 4 is a cross-sectional view of the doll taken along line 4—4 of FIG. 3.
Figure 5:
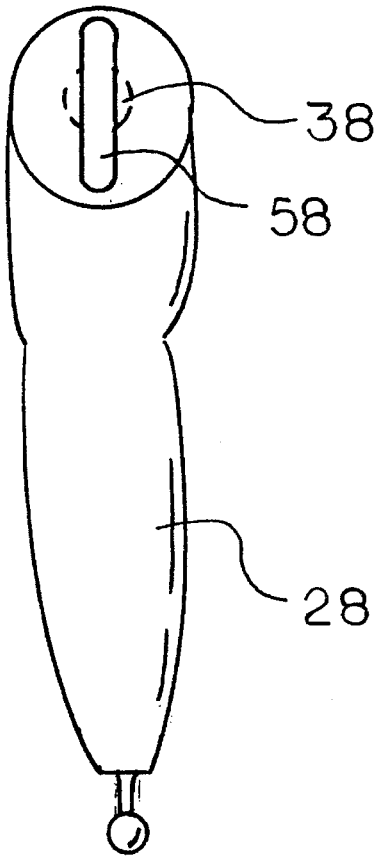
FIG. 5 is a cross-sectional view of the portion of the doll taken along line 5—5 of FIG. 3.

With reference now to the drawings, and in particular to FIG. 1 thereof, the preferred embodiment of the new and improved dolls formed in the likeness of the Lord Jesus with a movable head and extremities embodying the principles and concepts of the present invention and generally designated by the reference numeral 10 will be described.

Specifically, it will be noted with reference to FIGS. 1 through 5 there is shown the new and improved doll 10. The doll is formed in the likeness of the Lord Jesus. In its broadest of terms, the doll includes a torso 12, a movable head 14 and additional extremities coupled with respect thereto.

More specifically, the central component of the doll is a torso section 12. The torso section is formed of plastic in the shape of a human torso. It includes a loin cloth 16 molded into its lower portion. It also includes two laterally extending lower bulb like projections 18, two laterally offset upper bulb like projections 20 and two upwardly extending supplemental bulb like projections 22. The projections are each adapted for the movable receipt of additional sections of the doll.

The additional sections of the doll 10 include the leg sections 26 and the arm sections 28. The leg sections 26 are a pair of leg sections 26. They are formed of plastic in the shape of human legs. Each leg section has a bulb like recess 30 at its upper end for receiving a lower projection 18 of the torso. Formed therebetween are movable couplings which are readily rotatable. The lower ends of the leg sections have downwardly extending bulb like projections 32 for receiving feet sections.

A pair of feet sections 34 formed of plastic in the shape of human feet are next provided. The feet are each formed with recesses 36 in a bulb like configuration at their upper extents. Such recesses 36 are for receiving the projections 32 at the lower ends of the leg sections 26.

Next provided is a pair of arm sections 28. The arm sections are formed of plastic in the shape of human arms. Bulb like recesses 38 are formed at their upper ends. Bulb like projections 40 extend downwardly from the lower ends of the arm sections 28.

Hand sections 44 of plastic are provided in the shape of human hands. The hands are formed having upwardly extending bulb like recesses 46 for receiving the bulb like projections 40 at the lower ends of the arm sections 28.

Formed in the shape of a human head is a head section 14 with hair 50. The hair is on the face and on the head and extends downwardly to a location beneath the lower end of the head section. The head section has at its lower extent a pair of parallel, laterally offset bulb like recesses 52 for the receipt of the bulb like projections 22 at the upper extent of the torso 12. The recesses 52 and 38 of the head and arms include vertically extending slots 56 and 58. Such slots allow the extended pivoting therein of the head and arms along the slots.

Figure 6:
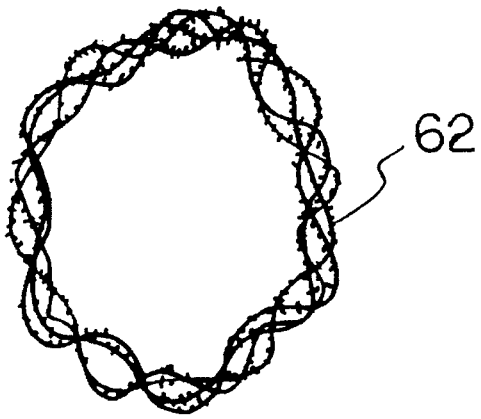
FIG. 6 is a plan view of a crown of thorns to be used in association with the doll of FIGS. 1 and 3.

FIG. 6 is an illustration of an alternate embodiment of the invention. In such alternate embodiment supplemental components are provided for coupling with respect to the doll 10. Such supplemental components include a crown of thorns 62 in an annular configuration for placement upon the head section 14 of the doll 10.

Figure 7:
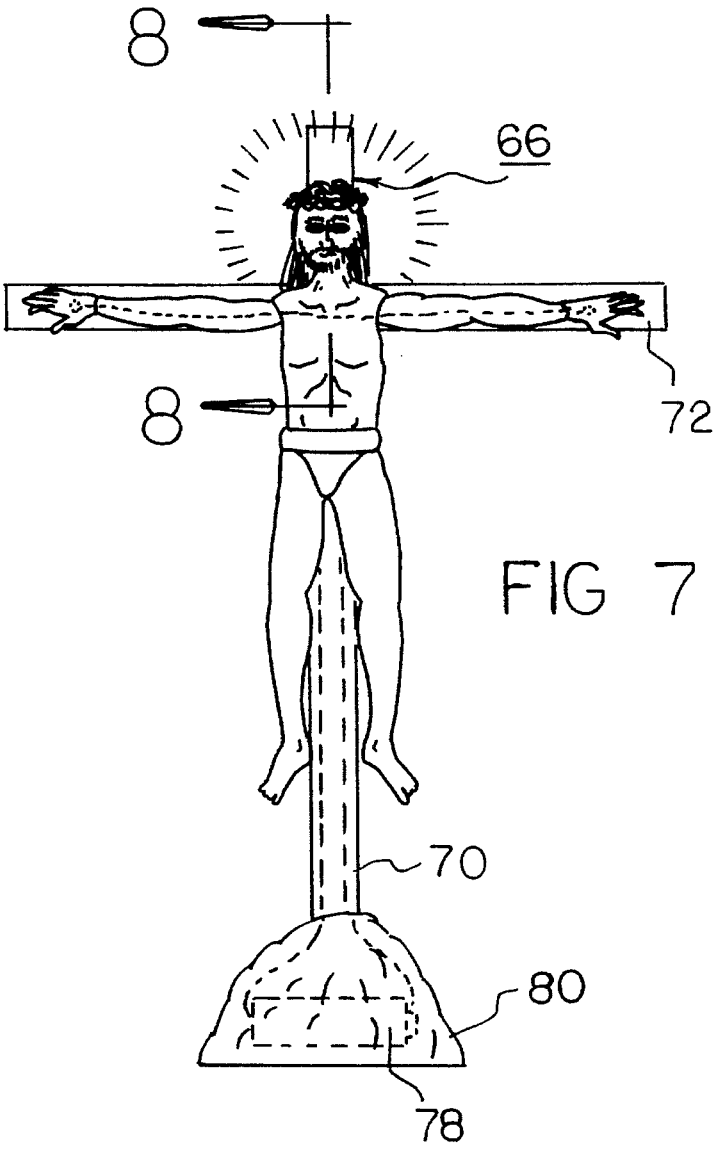
FIG. 7 is a front elevational view of the doll and a cross with the doll mounted on the cross.
Figure 8:
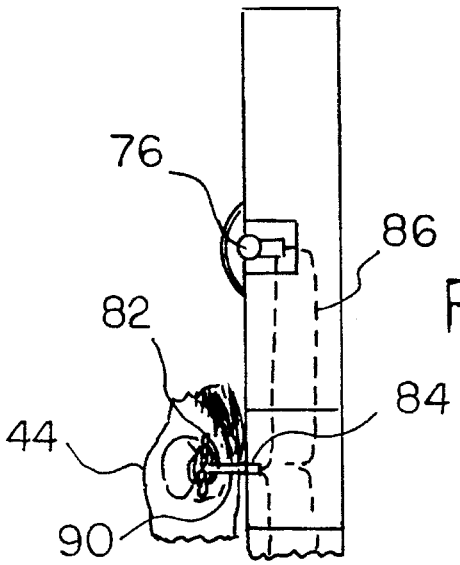
FIG. 8 is a cross-sectional view taken along line 8—8 of FIG. 7.

Another alternate embodiment of the invention is illustrated in FIGS. 7 and 8. In such embodiment, there is provided a cross 66. The cross is fabricated of an electrically insulating material and has a vertical portion 70 and a horizontal portion 72. Illumination means in the form of a bulb 76 is located within the cross 66 for its illumination. A battery 78 is also provided within the base 80 of the cross. The battery is for powering the illumination means. The cross has recesses 84 at the ends of the horizontal portions 72. Electrically conductive nails 82 are also provided. Such nails are adapted to complete the circuit between the battery 78 and the illumination means 76. The nails are thus positionable through apertures 90 in the hand sections of the doll 10 to support the doll upon the cross and to close the circuit 86 for illuminating the light bulb 76.

The present invention is a toy that will be appreciated by parents who are tired of troll dolls, Teenage Mutant Ninja Turtles, G.I. Joe dolls and the like. As the name makes plain, the present invention is a doll modeled after the likeness of Jesus. The advantages of this doll are that it ties in with children's religious training and provides them with something representing the best qualities in human beings instead of fostering the concepts of violence and egotism.

The present invention is made of molded plastic and stands about 10 inches tall. The model for this doll is the one seen in many paintings of Jesus, with long, shoulder-length hair and a beard. The face is smiling, and there is a gentle and thoughtful yet strong feeling to it. A loin cloth is included as part of the molded plastic form so as to preclude exposing the genital area of the doll.

A full line of accessories is available for the present invention. Some of these are a thorny crown, a traditional robe of the sort commonly worn in Jesus' time, slippers, a miniature Bible, and numerous other items. Dolls of other key characters from the Bible could also be produced as well: Moses, John the Baptist, Joseph and Mary, for example. Children will be able to have hours of fun recreating the Bible stories they have heard. The fact that the present invention has movable arms, legs, and a head that tilts up and down makes it that much more enjoyable for children.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved doll formed in the likeness of the Lord Jesus with a movable head and extremities comprising, in combination:

a torso section formed of plastic in the shape of a human torso and including a loin cloth molded into its lower portion and with two laterally extending lower bulb like projections, two laterally extending upper bulb like projections and two upwardly extending bulb like projections, the projections adapted for the movable receipt of other sections;

a pair of leg sections formed of plastic in the shape of human legs, each having a bulb like recess at its upper end for receiving the lower projections of the torso to form a movable coupling therebetween, the lower ends of the leg sections having downwardly extending bulb like projections for the receipt of feet sections and with a pair of feet sections formed of plastic in the shape of human feet, each having recesses at its upper end for receiving the projections at the lower ends of the leg sections;

a pair of arm sections formed of plastic in the shape of human arms, each having a bulb like recess at its upper end and having bulb like projections extending downwardly from their lower ends with a pair of hand sections formed of plastic in the shape of human hands, each having a bulb like recess at its upper end for receiving the projections at the lower ends of the arm sections;

a head section formed of plastic in the shape of a head with hair on the face and on the head extending downwardly beneath the lower end of the head section, the head portion having at its lower extent bulb like recesses for receiving the two upwardly extending bulb like projections of the torso, the recesses of the head and arms including vertical slots to allow the pivoting therein of the head about the bulbs as well as pivoting and rotation of the arms about the bulbs;

supplemental components for coupling with respect to the doll, such supplemental components including a crown of thorns in an annular configuration to be fit onto the head section; and a cross formed with a horizontal portion and a vertical portion and with illumination means therein and a battery for powering the illumination means, the cross having recesses at the ends of the horizontal portions with an electrical circuit and electrically conductive nails adapted to complete the circuit between the battery and the illumination means, the nails being positionable in apertures through the hand sections to support the doll on the cross and to complete the circuit for illuminating the light.

2. A doll in the likeness of the Lord Jesus with a movable head and extremities comprising:

a torso section formed of plastic in the shape of a human torso and including a loin cloth molded into its lower portion and with two laterally extending lower bulb like projections, two laterally extending upper bulb like projections and two upwardly extending bulb like projections, the projections adapted for the movable receipt of other sections;

a pair of leg sections formed of plastic in the shape of human legs, each having a bulb like recess at its upper end for receiving the lower projections of the torso to form a movable coupling therebetween, the lower ends of the leg sections having downwardly extending bulb like projections for the receipt of feet sections and with a pair of feet sections formed of plastic in the shape of human feet, each having recesses at its upper end for receiving the projections at the lower ends of the leg sections;

a pair of arm sections formed of plastic in the shape of human arms, each having a bulb like recess at its upper end and having bulb like projections extending downwardly from their lower ends with a pair of hand sections formed of plastic in the shape of human hands, each having a bulb like recess at its upper end for receiving the projections at the lower ends of the arm sections;

a head section formed of plastic in the shape of a head with hair on the face and on the head extending downwardly beneath the lower end of the head section, the head portion having at its lower extent bulb like recesses for receiving the two upwardly extending bulb like projections of the torso, the recesses of the head and arms including vertical slots to allow the pivoting therein of the head and arms in addition to rotation of the arms about the bulbs; and a cross formed with a horizontal portion and a vertical portion and with illumination means therein and a battery for powering the illumination means, the cross having recesses at the ends of the horizontal portions with an electrical circuit and electrically conductive nails adapted to complete the circuit between the battery and the illumination means, the nails being positionable in apertures through the hand sections to support the doll on the cross and to complete the circuit for illuminating the light.

* * * * *